United States Patent [19]

Totten

[11] 4,154,639

[45] May 15, 1979

[54] BOTTLE LABELLER

[75] Inventor: Roger W. Totten, Littleton, Colo.

[73] Assignee: Adolph Coors Company, Golden, Colo.

[21] Appl. No.: 859,576

[22] Filed: Dec. 12, 1977

[51] Int. Cl.[2] ..... B65C 9/12; B65H 1/06; B65H 3/06

[52] U.S. Cl. ..... 156/364; 156/568; 156/571; 156/DIG. 30; 271/23; 271/120; 271/256

[58] Field of Search ..... 156/364, 571, 570, 568, 156/DIG. 30, DIG. 29; 271/16, 21, 117, 120, 256, 23

[56] References Cited

U.S. PATENT DOCUMENTS

| | | | |
|---|---|---|---|
| 2,967,636 | 1/1961 | Manas et al. | 156/364 |
| 3,572,691 | 3/1971 | Heinricy | 271/23 |
| 3,654,024 | 4/1972 | Heinricy | 156/571 X |
| 3,864,187 | 2/1975 | Carter | 156/571 X |
| 4,052,050 | 10/1977 | Carter | 156/571 X |

*Primary Examiner*—Michael G. Wityshyn
*Attorney, Agent, or Firm*—Kyle W. Rost

[57] ABSTRACT

In a bottle labeller of the type having a rotating discharge roller with an extending finger that withdraws a label from a magazine, the discharge roller contains a piston in which the finger is carried by a complimentary shape of a slot in the piston with the base of the finger. The piston moves in a cylindrical bore both axially and rotatably to retract the finger from extended position into the roller when a bottle detecting system discovers an interruption in the flow of bottles to the labeller. The detecting system directs pressurized air to the roller, forcing the piston to move in the bore and retract the finger when an interruption is discovered.

6 Claims, 10 Drawing Figures

BOTTLE LABELLER

BACKGROUND OF THE INVENTION

1. Field of the Invention

The invention relates to apparatus for sheet feeding and delivering. Specifically, the invention is an improved bottle label feeder.

2. Description of the Prior Art

Many devices are known for withdrawing a lable from a magazine, feeding the label through appropriate adhesive applying means, and placing the label on a passing bottle in a bottling line. One such device is taught in U.S. Pat. No. 3,572,691 to Heinricy, in which the label is withdrawn by friction with a rotating finger, after which the label is pinched between a roller and counter roller that pull the label completely free of the magazine and feed it to a glue roller.

A further refinement of this apparatus is taught in U.S. Pat. No. 3,654,024 to Heinricy, wherein a mechanism is provided for interrupting the operation of the finger on the labels when the supply of passing bottles is interrupted. While this mechanism accomplishes the desired function, it is inaccurate when responding to an intermittent stream of bottles and its speed and response time are limited by the relatively massive mechanism that must be moved. The present invention provides improved speed, response time and control for stopping the procession of labels when the bottle supply is interrupted.

Another problem in the apparatus of the Heinricy patents mentioned above is that the label picking finger is subject to wear and must be replaced periodically. The job has required mechanical disassembly of the roller in which the finger is mounted, causing undue delay in the operation of the bottle line. The present invention also remedies this situation.

SUMMARY OF THE INVENTION

In a bottle labeller of the kind having a discharge roller that rotates a resilient finger against a label held in a magazine to extract the label, the discharge roller contains a bore offset from the vertical axis of the roller, and within the bore is a piston that retains the inner end of the resilient finger by a complimentary fit of the finger in a slot of the piston. The piston may move both axially and rotatably in the bore, and engages helical means for rotating the piston as it is axially moved by pneumatic means in response to the anticipated presence or absence of a bottle to be labelled. The pneumatic means is controlled by a logic circuit that detects the approach of a bottle or the absence of a bottle, and directs the pneumatic means to position the piston in the appropriate manner. In one position of the piston, the finger is extended and will remove a label to be applied to a specific detected bottle, while in a second position the finger is retracted into the discharge roller and will not remove a label, as no bottle will be present to receive a label that otherwise would have been removed during that revolution of the discharge roller.

The main object of the invention is to create an apparatus for perfectly controlling the feed of labels in a bottle labeller to exactly correspond to the position of bottles fed through a bottle line. The apparatus detects not only general interruptions in the bottle flow, but responds to each individual bottle for perfect labelling accuracy at all speeds within the capability of the labeller.

Another object of the invention is to create a discharge roller having simplified maintenance requirements. The present apparatus utilizes a piston that retains the resilient finger by complimentary fit of the finger in a slot of the piston, allowing the finger to be replaced by a simple forceful extraction and insertion.

DESCRIPTION OF THE PREFERRED EMBODIMENT

The overall operation of a bottle labeller 10 adapted to employ the present invention is fully described in U.S. Pat. No. 3,572,691 and 3,654,024, both to Heinricy, incorporated by reference herein for this teaching.

Figure 1:
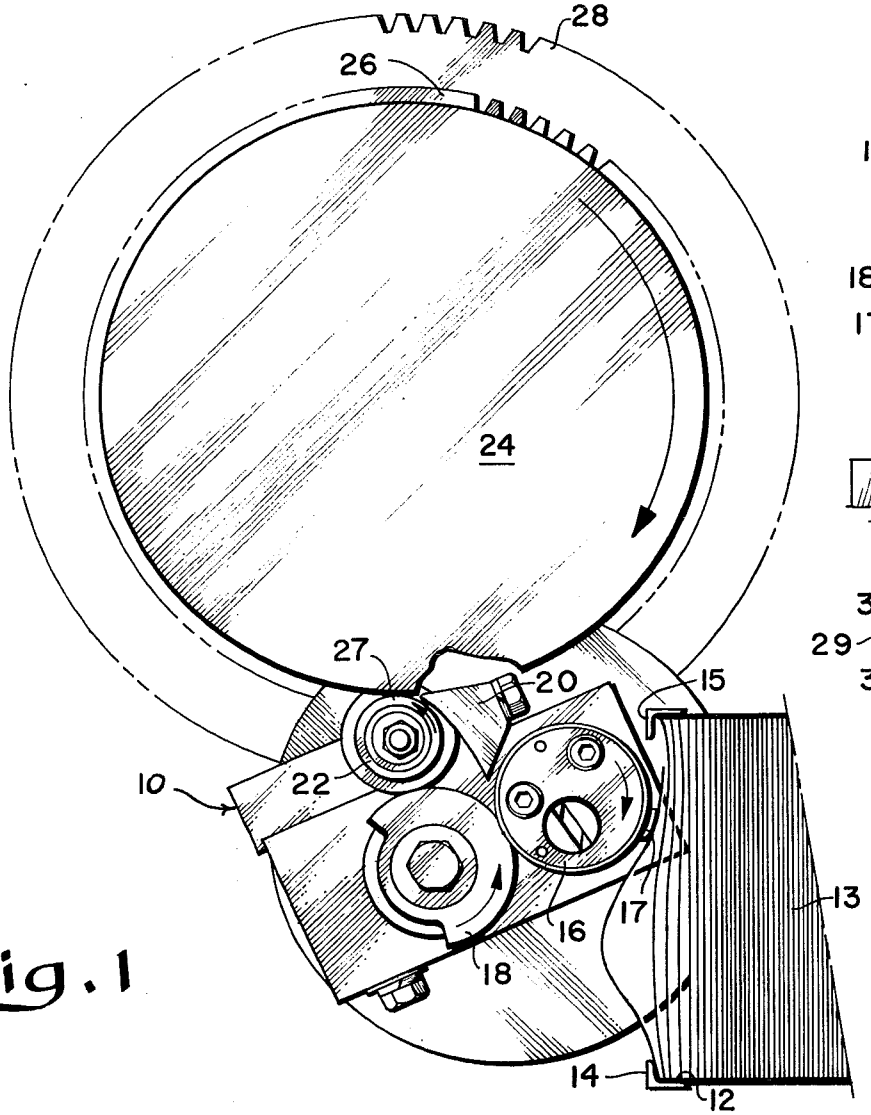
FIG. 1 is a top plan view of the discharge roller and related apparatus of the labeller.

In the embodiment shown in FIG. 1, a magazine 12 contains labels 13 biased against the forward sides 14, 15 of the magazine. A discharge roller 16 rotates in the clockwise direction as viewed in FIG. 1 to bring radially extending finger 17 into contact with the outermost label of magazine 12, freeing the label from side 15. The label is then directed by the movement of roller 16 into a position between that roller and counter roller 18, where the label is pinched and pulled free of magazine side 14. Subsequently, the label passes between guide 20 and roller 22 into contact with glue roller 24, which carries the label to a labelling station where the label is applied to a bottle passing on a conveyor belt, all in well known manner forming no part of the present invention.

Figure 2:
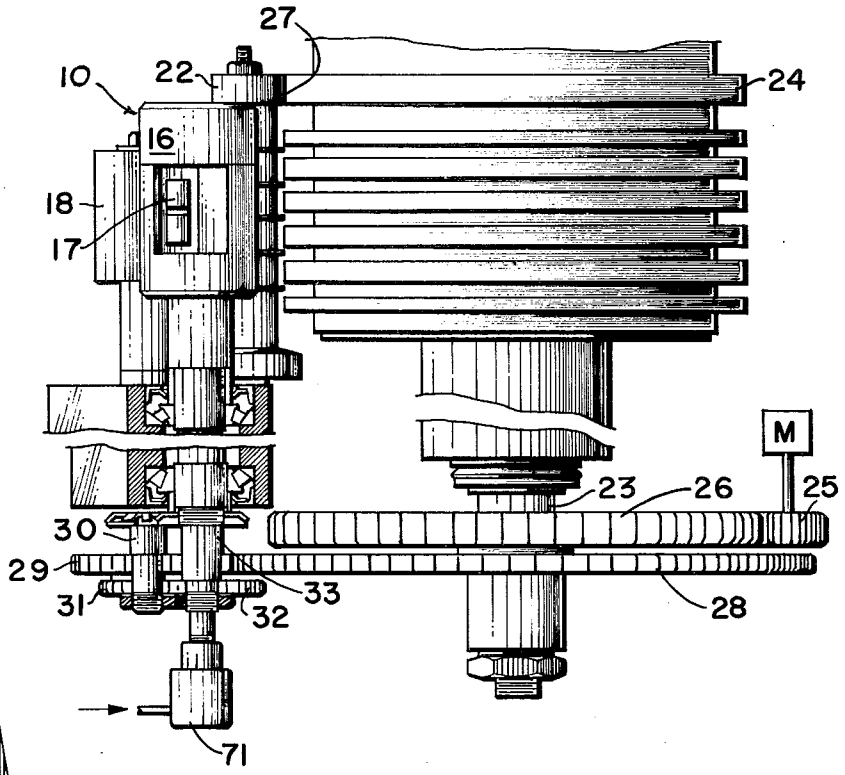
FIG. 2 is a side elevational view of the apparatus of FIG. 1, with the label magazine removed for clarity.

Operating power for the labeller is supplied by variable speed motor M, FIG. 2, that drives the glue roller 24 by any conventional means, such as by geared engagement between gears 25 and 26. Glue roller 24, in turn, transmits power to all other parts of the labeller so that perfect synchronization is achieved. Roller 22, for example, may be driven by tangental contact with roller 24 at 27. Gear 28 may be keyed to glue roller shaft 23 to rotate with gear 26 and mesh with gear 29 keyed to counter roller shaft 30. Also keyed to shaft 30 is gear 31 that meshes with gear 32 keyed to discharge roller shaft 33. Thus, the labeller is perfectly synchronized in all of its rotating parts by gear engagements and is capable of operating at extremely high speeds while delivering labels with accuracy.

With reference to FIGS. 3–6, the discharge roller 16 has window 36 in the circumferential wall of the roller at a position corresponding to the relative height of the labels 13 in magazine 12. Finger 17 is ordinarily extending through window 36 in a position to contact the outer label in magazine 12, but the finger may be retracted into recessed area 37, behind window 36, FIG. 5, by pivoting the finger at a point non-coaxial with the axis of rotation of the discharge roller.

Figure 5:
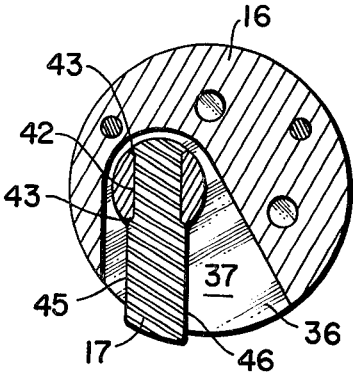
FIG. 5 is a cross-sectional view taken along the plane of line 5—5 of FIG. 3.
Figure 4:
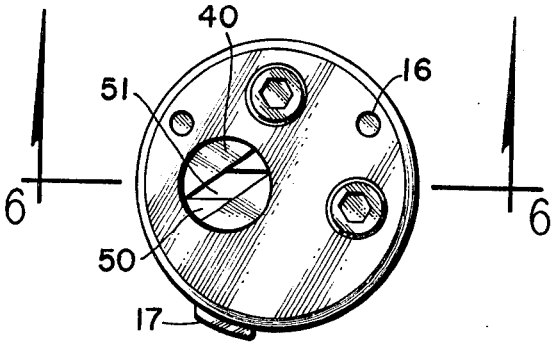
FIG. 4 is a top plan view of the discharge roller of FIG. 3.
Figure 6:
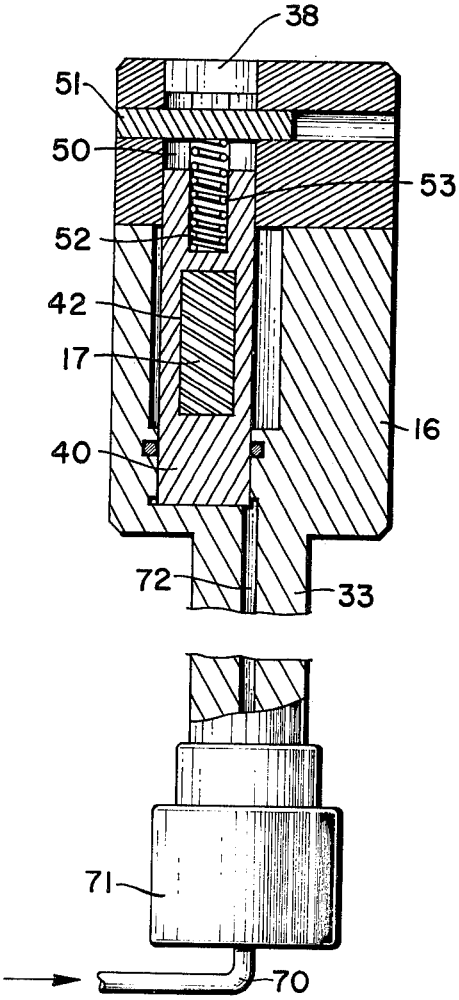
FIG. 6 is a vertical cross-sectional view taken along the plane of line 6—6 of FIG. 4.
Figure 3:
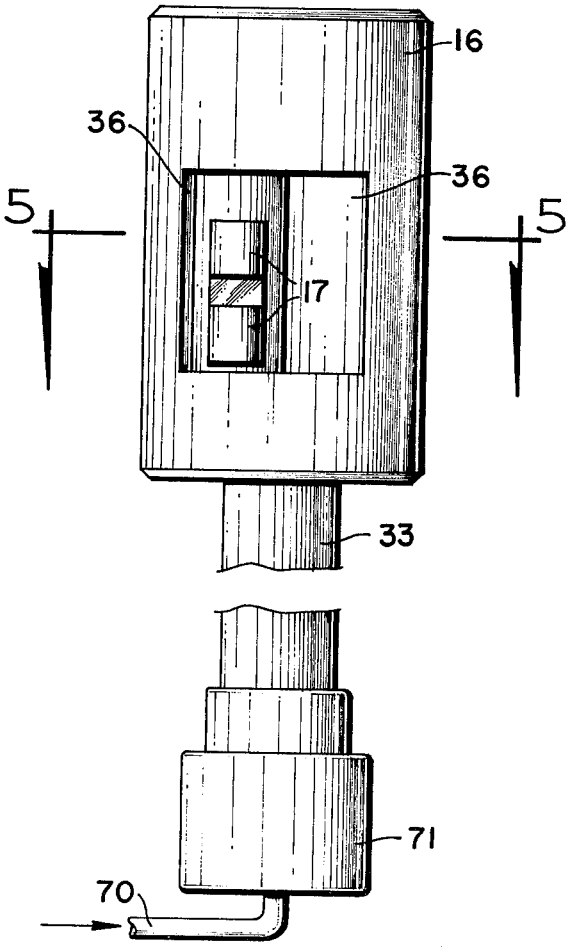
FIG. 3 is a side elevational view of the discharge roller.
Figure 9:
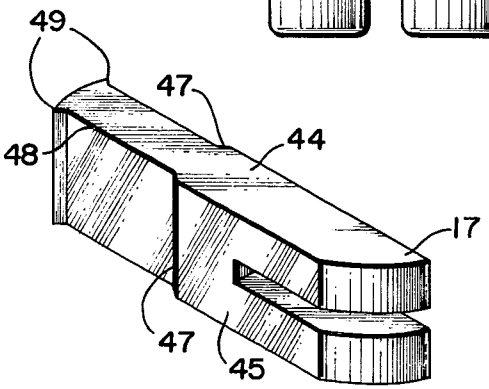
FIG. 9 is an isometric view of the finger.

Within head 16 is non-coaxial cylindrical bore 38 containing piston 40, both of which extend through the innermost portion of area 37, FIG. 5. Piston 40 contains a slot 42 shaped to receive the inner end of finger 17. For example, the slot may be rectangular in vertical cross-section, as shown in FIG. 6, while the forward and rearward vertical edges of the slot are outwardly beveled at 43, as shown in FIG. 5. As best shown in FIGS. 5 and 9, the finger 17 may have flat horizontal upper and lower surfaces 44, forward side 45 and rearward side 46 may be parallel for most of their respective lengths, but they angle mutually inwardly and rearwardly at 47 before resuming parallel configuration in relatively narrow portion 48 that fits in slot 42. At the rearward end of finger 17, sides 45 and 46 diverge at 49. Finger 17 is constructed of a resilient material such as polyurethane or natural gum rubber, not only to create proper friction between the finger and the labels, but also to allow the finger to be inserted through slot 42 into firmly engaged relation with piston 40. While portion 48 is held within the slot, angle portions 47 and 49 engage the beveled edges 43. The finger 17 may be removed and replaced by merely pulling the finger free of slot 42 through window 36, and pushing a replacement finger back into the slot. However, the finger will not be thrown free of the slot despite high speed rotation of roller 16.

Figure 8:
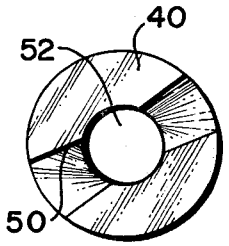
FIG. 8 is an elevational view taken from the right hand side of FIG. 7.
Figure 7:
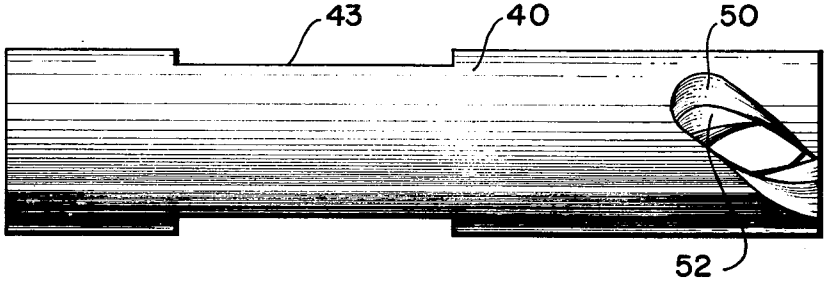
FIG. 7 is an elevational view of the piston, showing the helical slot.

Piston 40 serves not only as a holder for finger 17, but also is an important part of a finger retraction system that moves the finger into recess 37 when it is desired to interrupt the removal of labels 13 from magazine 12. For this purpose, the piston is axially slidable and rotatable in bore 38. Near the top of piston 40, as shown in FIGS. 6–8, is a transverse slot 50 that extends upwardly in a counterclockwise helix as viewed from the top of FIG. 6. Through this slot is a pin 51 fixed in roller 16. The piston 40 has an axial bore 52 passing through the vertical distance occupied by the helical slot 50 and containing spring 53 tensioned between the terminal wall of the bore 52 at its lower end and pin 51 at its upper end.

With the described configuration, if the piston 40 is at the bottom of bore 38, the slot 42 is so positioned that finger 17 extends out of window 36 in position to contact a label in magazine 12 and is positioned near the clockwise extreme of window 36, viewed from the top of roller 16 as shown in FIG. 5. If the piston is vertically raised in bore 38, the piston must rotate in the counterclockwise direction as viewed in FIG. 5 as the helical slot 50 moves with relation to stationary pin 51, retracting finger 17 into area 37. The upward motion of piston 40 is opposed by spring 53 also acting on pin 51 and is limited by the lower extreme of slot 50, which also urges the piston to rotate in the clockwise direction.

Figure 10:
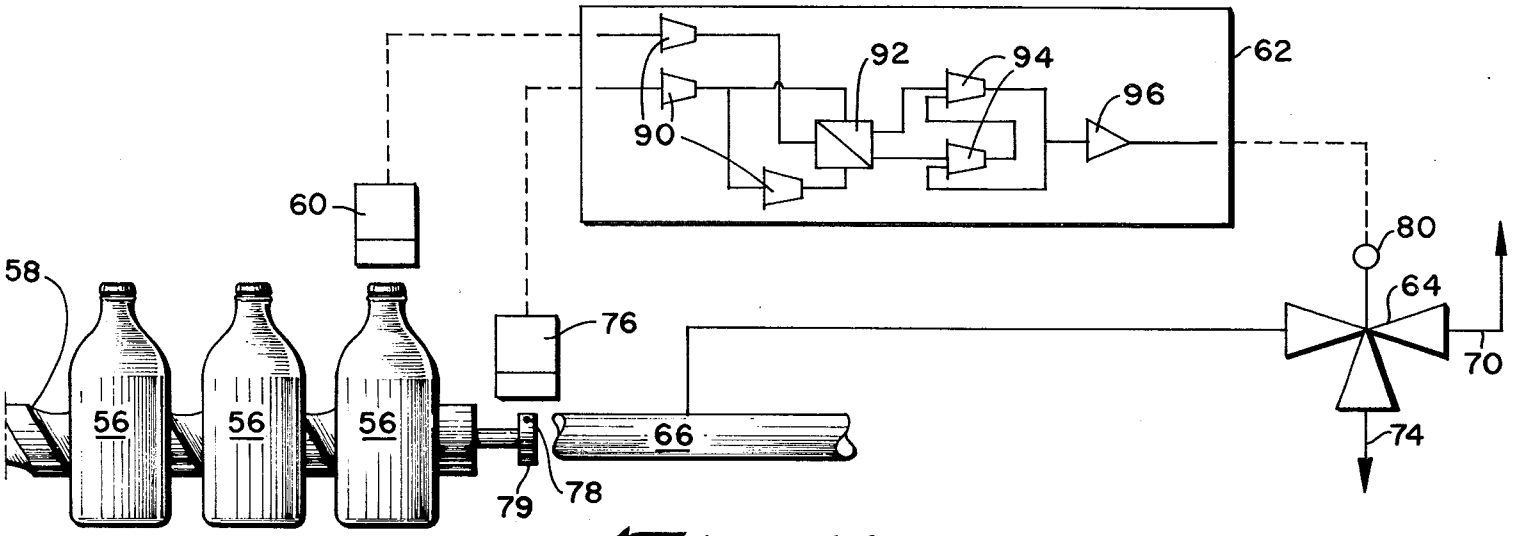
FIG. 10 is a schmetic view of the bottle detection system that controls the movement of the piston.

Means are provided for automatically raising the piston in bore 38, thereby retracting finger 17 and preventing a label from being withdrawn, whenever a bottle will not be present at the labelling station to receive the label that would otherwise be withdrawn from magazine 12. As best shown in FIG. 10, the bottles 56 are transported by any conventional means such as a conveyor belt to a mechanism for delivering the bottles to the labelling station in a controlled manner, such as timing screw 58, which rotates in synchronization with the labeller 10, for example by gear drive coupled to the glue roller.

One or more proximity switches 60, are located above the bottle path upstream of the labelling station at a position where the switch 60 may detect the presence or absence of the bottle prior to the time that finger 17 withdraws the label intended for that bottle. Switch 60 is connected to a logic circuit 62 that tells the switch when to check for the presence of a bottle, and if no bottle is detected, directs valve 64 to send pressurized air from air supply 66 through conduit 70, which is connected to the base of shaft 33 by rotary union 71, FIGS. 3 and 6. The air travels through passage 72, FIG. 6, which connects to the base of bore 38, where the air raises piston 40 and automatically retracts finger 17 just before the label intended for the missing bottle is withdrawn.

If the bottle is detected by switch 60, then logic circuit 62 causes valve 64 to vent the pressurized air from conduit 70, through outlet 74, allowing spring 53 to lower piston 40 and extend finger 17. It should be understood that switch 60 detects the presence of a bottle by detecting the metal cap on the bottle. This process is extremely accurate and can extend or withdraw finger 17 in anticipation of the presence or absence of one or more bottles at extremely high speeds, for example, over 700 bottles per minute, with perfect accuracy.

Logic circuit 62 repeatedly or continuously checks to see if the timing screw is in proper position to have a bottle or empty bottle space under the proximity switch. This function may be accomplished by having another proximity switch 76 seeking a metal timing mark 78 on the screw 58 or on a timing cam 79 rotating elsewhere in the linkage delivering power to the screw. The timing mark is located to be directly under switch 76 whenever the screw is potentially holding a bottle under switch 60. If the timing mark is not detected, the circuit seeks the mark again, but if the mark is detected, then switch 60 inspects for the presence of a bottle cap. If no cap is detected, the circuit may de-energize solenoid 80 of valve 64, causing the pressurized air to be fed to the discharge roller; but if a bottle cap is detected, the solenoid is energized and valve 64 vents the air from the discharge roller, allowing the finger to extract a label for the detected bottle. Despite the repeated or constant inspection for bottles by the electronic circuitry, the mechanical operation of solenoid 80 and in turn the movement of piston 40 occur only when there is a change in the continued presence or absence of bottles passing switch 60, resulting in a minimum of mechanical wear consistent with perfect accuracy in label delivery. Switch 76 and mark 78 are also located to time the actuation of the finger position change at a point just after the finger has done its job of extracting the preceeding label.

The specific design of logic circuit 62 is not critical to the invention, as switch 76 could merely trip a relay when timing mark 78 is detected, thereby activating switch 60 to either activate or deactivate solenoid 80 according to whether a bottle cap is detected. A preferred construction of logic circuit 62, illustrated in FIG. 10, employs hardware sold by Square-D under the trademark Norpak. The three gates 90 are Norpak "nor" gates, which operate as more commonly known "not" gates when used with only one input as in the illustrated circuitry. The three gates 90 are connected to Norpak transfer gate 92, which is in turn connected to Norpak "nor" gates 94. Output amplifier 96 is connected between gates 94 and solenoid 80.

The three gates 90 constitute input logic means that determines when switch 76 has detected the timing mark 78 and when switch 60 has detected a bottle cap. Transfer gate 92 interprets the input from switch 76 to appropriately activate switch 60, and also receives the signal from switch 60 if a bottle is detected. Gates 94 constitute a memory means and are connected in a reset-set flip-flop for causing a change in the activated or deactivated state of solenoid 80 only if required by a change from the immediately preceeding bottle condition detected by switch 60.

I claim:

1. An improved bottle labeller of the kind having a continuously rotating discharge roller carrying a resilient finger extending from the cylindrical side of the roller for extracting a label from an adjacent magazine and feeding the label to associated mechanism for applying the label to a passing bottle in a bottle line, the finger being the kind that is retractable into or extendable from a recessed area of the discharge roller in response to bottle flow monitoring means detecting the absence or presence, respectively, of bottles on the bottle line, wherein the improvement comprises:

(a) said discharge roller having a cylindrical bore therein offset from and parallel to the axis of rotation of the roller;

(b) a piston carried by and axially moveable within said bore, the piston having a cylindrical outer surface terminating in first and second end surfaces at the respectively opposite ends of the piston;

(c) connecting means for attaching said piston to the resilient finger;

(d) first helical guide means on said piston;

(e) second guide means on said discharge roller for cooperating with said first helical guide means in directing the piston and carried finger through a predetermined rotation in response to axial movement of the piston in the bore, the finger being in an extended position at one extreme of the predetermined rotation and being retracted at the opposite extreme of the predetermined rotation;

(f) fluid control means responsive to the bottle flow monitoring means for applying a pressurized fluid to one side of said piston, urging the piston to move axially in said bore in response to a predetermined detected condition of bottles in the bottle line.

2. The bottle labeller of claim 1, wherein said first helical guide means comprises a slot twisting helically in said piston about the axis thereof, and said second guide means comprises an elongated member fixed to the discharge roller and extending transversely into said slot, relative to the axis of the piston.

3. The bottle labeller of claim 1, wherein said fluid control means comprises:

(a) a supply of pressurized air;

(b) a valve having a first position directing said pressurized air to said bore at the first end of the piston for urging the piston to move in the direction of said second end thereof opposite from said first end whereby the finger is moved to its retracted position, the valve having a second position venting the bore at the first end of the piston whereby the finger is moved to its extended position; and (c) wherein said bottle flow monitoring means comprises means for sensing a metallic bottle cap on a bottle passing a predetermined point in the bottle line, and means for moving said valve to said first position if no cap is detected but moving the valve to a second position if a cap is detected.

4. The bottle labeller of claim 3, further comprising resilient means for urging said piston in the direction of the first end thereof in opposition to the pressurized air from said valve in its first position.

5. The bottle labeller of claim 1, wherein said connecting means comprises:

(a) a slot formed in the cylindrical wall of said piston and having a shape complimentary to a portion of the finger received therein, the finger having an outer end for contacting labels in the magazine and an opposite inner end received in said slot;

(b) said finger having first and second opposite sides extending in mutually divergent directions near the inner end thereof; and (c) said slot having first and second opposite sides corresponding to said first and second finger sides and having corresponding divergent portions for engaging the divergent sides of the finger in retained relationship.

6. The bottle labeller of claim 1, wherein said connecting means comprises:

(a) a rectangular slot formed in the cylindrical wall of said piston and extending therethrough, the slot being defined by first and second parallel opposite sides, each of said sides having outwardly beveled edges at its intersections with said cylindrical outer surface of the piston;

(b) a complimentarily shaped portion of said finger engaged in said slot and having first and second opposite parallel sides defining the length and width of the portion of the finger engaged in the slot, said first and second finger sides having mutually outwardly divergent portions at positions to mate with the beveled edges of the slot, the mating configuration of the slot and finger preventing axial movement of the finger in the slot.

* * * * *